United States Patent [19]

Inoue et al.

[11] 4,302,405

[45] Nov. 24, 1981

[54] VARIABLE VENTURI TYPE CARBURETOR

[75] Inventors: Tokuta Inoue; Norihiko Nakamura, both of Mishima; Takaaki Itoh, Susono, all of Japan

[73] Assignee: Toyota Jidosha Kogyo Kabushiki Kaisha, Aichi, Japan

[21] Appl. No.: 118,961

[22] Filed: Feb. 5, 1980

[30] Foreign Application Priority Data

May 10, 1979 [JP] Japan ..... 54-56347

[51] Int. Cl.[3] ..... F02M 9/06

[52] U.S. Cl. ..... 261/44 C; 261/52

[58] Field of Search ..... 261/44 C, 44 B, 52

[56] References Cited

U.S. PATENT DOCUMENTS

| | | | |
|---|---|---|---|
| 2,672,329 | 3/1954 | Zarnack | 261/44 B |
| 3,272,488 | 9/1966 | Bickhaus | 261/50 A |
| 3,301,536 | 1/1967 | Swatman et al. | 261/44 B |
| 3,322,408 | 5/1967 | Stoltman | 261/52 |
| 3,333,832 | 8/1967 | O'Neill | 261/44 C |
| 3,985,838 | 10/1976 | Marsee | 261/44 C |

FOREIGN PATENT DOCUMENTS

| | | | |
|---|---|---|---|
| 832361 | 2/1952 | Fed. Rep. of Germany | 261/44 B |
| 2106501 | 8/1971 | Fed. Rep. of Germany | 261/44 C |
| 46-37065 | 10/1971 | Japan | 261/44 C |
| 3257 | of 1906 | United Kingdom | 261/44 B |
| 1300985 | 12/1972 | United Kingdom | 261/44 C |

*Primary Examiner*—Tim R. Miles

*Attorney, Agent, or Firm*—Browdy and Neimark

[57] ABSTRACT

A variable venturi type carburetor includes a suction chamber, a suction piston moveable into and out of the chamber, a metering needle attached to the head portion of the suction piston, the needle being faced by a metering jet. The carburetor also includes a throttle valve. The head portion confronts the venturi section at the upstream side of the throttle valve. The head portion is obliquely cut or shaped at one side, which faces the throttle valve, and desirably is so positioned relative to the throttle valve that at least a portion of the throttle valve pivots during opening movement within space vacated by the obliquely cut or shaped piston portion as the piston moves in an opening direction.

5 Claims, 4 Drawing Figures

Fig. 2
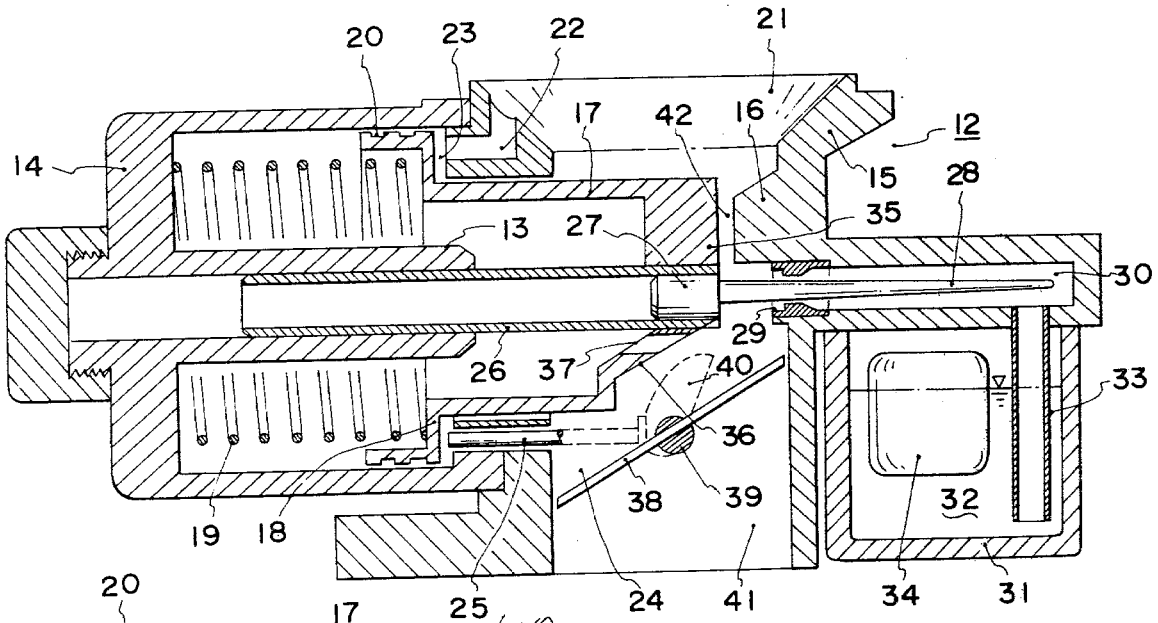
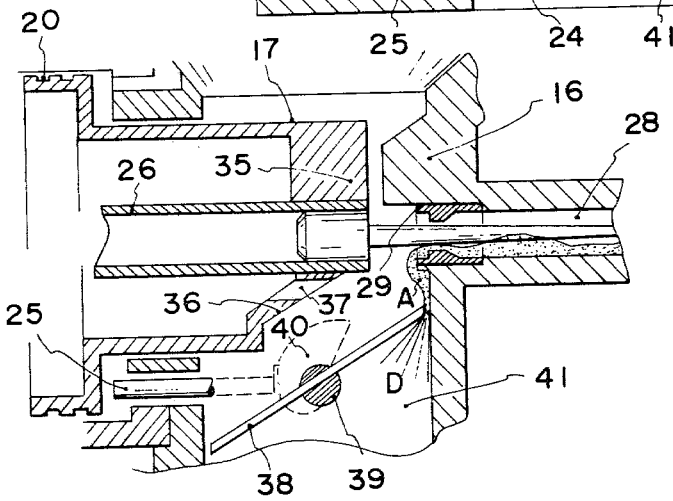
Fig. 3

VARIABLE VENTURI TYPE CARBURETOR

BACKGROUND OF THE INVENTION

1. Field of the Invention

The present invention relates to a variable venturi type carburetor having a suction piston adapted to move into and out of a suction chamber in accordance with the change of flow rate of the intake air so as to change the cross-sectional area of the venturi section defined at the upstream side of a throttle valve, and to meter the fuel to be injected through a cooperation of a metering needle attached to the head thereof with a metering jet.

More particularly, the invention is concerned with a variable venturi type carburetor in which the side of the suction piston head opposing to the throttle valve is cut and removed obliquely to avoid the attaching of fuel. Still more particularly, the invention is concerned with a variable venturi type carburetor of the kind stated above, wherein the throttle valve is so pivotally mounted that it can be fully opened without interference with the obliquely cut head of the suction piston, thereby to prevent the fuel from attaching to the inner peripheral surface of the throttle bore while reducing the whole height of the carburetor.

2. Description of the Prior Art

It is well known that carburetors for automobile engines or the like can be broadly sorted into a stationary or fixed venturi type carburetors and variable venturi type carburetors. In general, the latter exhibit various superiority or advantages over the former.

For instance, the variable venturi type carburetor has a simple construction. Namely, as shown in FIG. 1, the variable venturi type carburetor has a suction piston 2 adapted to be moved into and out of a suction chamber 1 in response to the change in the flow rate of the intake air so as to change the cross-sectional area of a venturi section 3 of the carburetor. At the same time, a metering needle 5 extended from the head 4 of the carburetor cooperates with a metering jet 6 in metering the fuel to be injected. Namely, this type of carburetor can meter only at first position, without any non-linearity or discontinuity of the metering characteristic. Therefore, this type of carburetor inherently has a superior transient response characteristic to that of the fixed or stationary venturi type carburetor. Thus, this type of carburetor is quite advantageous and preferred from the view point of current demand for pollution prevention.

There are, however, various drawbacks or shortcomings even in this variable venturi type carburetor, one of which is the unstable idling operation.

More specifically, in the variable venturi type carburetor, the throttle bore 7 of the single barrel is made to have a diameter large enough to effectively maintain a sufficiently large engine output under the condition of full-throttle opening. Therefore, in the operation state in which the fuel consumption is extremely small, i.e. when the flow rate of intake air is small as in the case of idling, the fuel coming from the metering jet 6 is not effectively suspended by the air in the throttle bore. As a result, the mixing of the fuel with air is rendered insufficient and incomplete so that the fuel flows assuming a form of a liquid fuel film A in contact with the inner surface of the barrel 8.

Then, the fuel attaching to the inner surface is kept in the attaching state, i.e. no atomizing energy is imparted to the liquid fuel attaching to the inner surface, due to a turbulency of the air flowing through the throttle barrel. Thus, the fuel forms a plurality of fuel pools B on the inner surface of the throttle bore 7 and falls directly onto the upper end surface of the throttle valve 9.

Meanwhile, the fuel scraped off from the inner surface by the head 4 of the suction piston 2 is accumulated on the lower edge 10 of the end of the suction piston head 4 to form a fuel pool C which also drops onto the upper end surface of the throttle valve 9.

These drops of fuel inconveniently cause uneven or not uniform distribution of fuel on the upper surface of the throttle valve 9. In addition, the distribution itself is unstable. In consequence, the flow of the mixture is unstabilized, even when the intake vacuum is high to generate a subsonic flow of intake air passing the edge of the throttle valve 9, as illustrated. This phenomenon has been confirmed through an experiment conducted employing a model of a carburetor made of a transparent plastic material.

As a result, as shown in FIG. 4*a*, the air-fuel ratio of the mixture is rendered unstable and, in case of a multi-cylinder engine, the distribution of the mixture over the all cylinders is rendered not uniform to seriously deteriorate the stability of the engine operation.

The problem of unstability of idling operation is important and vital. In order to overcome this problem, there have been take various countermeasures. One of these countermeasures is to set the idling speed of the engine at a relatively high level. This countermeasure, however, is not recommended because it inevitably deteriorates the fuel consumption particularly in the low-speed city running mode including repeated start and stop at crossings.

As an alternative countermeasure, it has been proposed to provide a slow passage separately so as to stabilize the idling operation. Although this countermeasure can provide a stabilized idling operation of the engine, it poses, on the other hand, a problem of undesirable so-called "discontinuity" or "non-linearity" of the characteristic in the transient region between the slow and main regions, due to the fact that the slow passage and the main passage are provided separately from each other, resulting in a deteriorated air-fuel ratio characteristic in the transient region. This seriously degrades and spoil the aforementioned advantage of the variable venturi type carburetor, i.e. the superior transient characteristic.

SUMMARY OF THE INVENTION

In view of the above explained problem in the prior art variable venturi type carburetor attributable to the attaching of the liquid fuel drops, the present invention aims at providing an improved and superior variable venturi type carburetor, in which, basically, the lower edge of the suction piston is cut obliquely to prevent the liquid fuel from attaching to that edge and to improve the distribution of the intake air and, correspondingly, the throttle valve is mounted at a level as high as possible so that the fuel ejected from the metering jet may collide with the throttle valve to stabilize the idling operation of the engine.

BRIEF DESCRIPTION OF THE DRAWINGS

FIG. 2 is a schematic illustration of an exemplary, first embodiment of a carburetor in accordance with the present invention.

FIG. 3 is an illustration showing the operation of the carburetor as shown in FIG. 2.

DETAILED DESCRIPTION OF THE PREFERRED EMBODIMENTS

Figure 1:
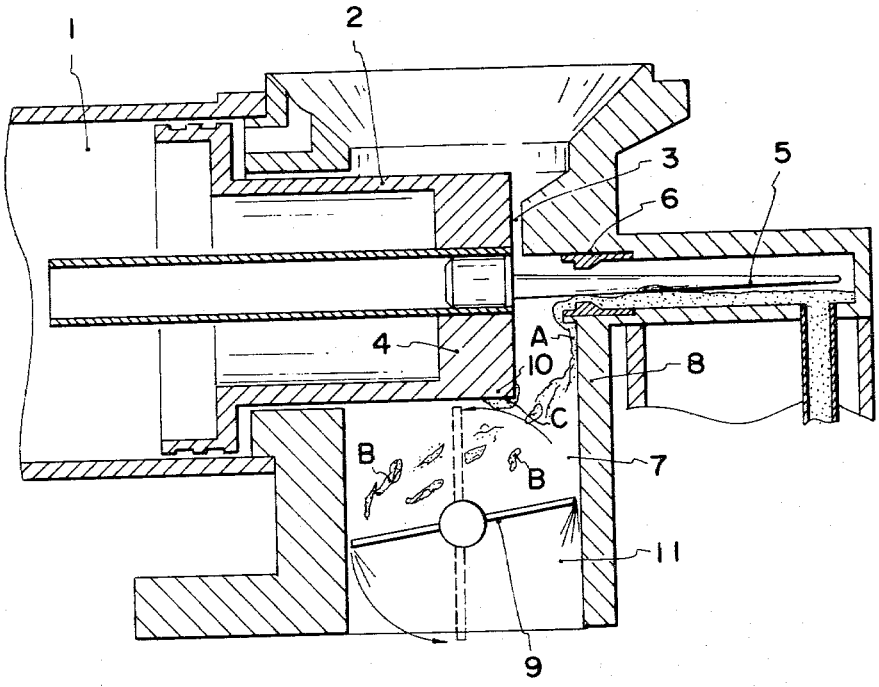
FIG. 1 is an illustration showing the state of injection of fuel in a conventional variable venture type carburetor in the idling state.

A preferred embodiment of the invention will be described hereinunder with reference to FIG. 2 and other subsequent figures.

FIGS. 2 and 3 show an air-damper type variable venturi carburetor 12 which is an embodiment of the invention. The carburetor 12 has a barrel 15 formed unitarily with a suction chamber 14 having therein a rod guide 13. A suction piston 17 opposing to a bridge 16 formed on the barrel 15 is adapted to slide into and out of the suction chamber 14. A suction spring is in the chamber and a flange 18 formed on the suction piston 17.

The flange 18 is provided with a labyrinth seal 20. The flange 18 partly defines an atmospheric chamber 23 communicated with a communication bore 22 leading from an air horn 21, and is disposed so as to be contacted by an opener rod 25 disposed in the throttle bore 24.

The suction piston 17 has an inner rod 26 slidably guided by the rod guide 13 of the suction chamber 14. A metering needle holder 27 is press-fitted into the end of the rod 26 and carries a metering needle 28 which is adapted to move together with the suction piston 17 concentrically with a metering jet 29. A reference numeral 30 denotes a fuel passage having a suction pipe 33 immersed in the fuel 32 accommodated by a float chamber 31. A reference numeral 34 designates a float.

The critical feature of the invention resides in that the lower end of the head 35 of the suction piston 17, from which the rod 26 is extended, is cut or shaped obliquely as illustrated to present an oblique or tapered surface 36 in which formed is a suction aperture 37.

A throttle valve is designated at a numeral 38. Thanks to the formation of the oblique or tapered surface 36, it is possible to locate the throttle valve 38 as close as possible to the suction piston, while avoiding the undesirable interference of the throttle valve with the suction valve during full-opening of the throttle valve. This in turn allows the mounting of the throttle valve shaft at a higher level than in the conventional carburetor. The upper edge of the throttle valve in the idling position is, therefore, located correspondingly close to the metering jet 29, and can be positioned in the region where the fuel injected from the metering jet 29 flows in the form of the liquid film.

The throttle valve shaft 39 carries a cam 40 which extends radially outwardly therefrom so as to engage the inner end of the opener rod 25.

A reference numeral 41 denotes a mixing chamber, while a venturi section is designated at a numeral 42.

In the carburetor constructed as above, the suction is moved in and out quickly responding to the change in the flow rate of intake air caused by the opening and closing of the throttle valve 38, until the force generated by the pressure in the chamber defined by the suction chamber 14 and the suction piston 17, the pressure being transmitted through the suction aperture 37, the force exerted by the suction spring 19, the force generated by the pressure in the atmospheric chamber 23 and the force generated by the pressure acting on the head 35 are balanced. As a result, the metering needle 28 meters the fuel coming from the float chamber 31, in cooperation with the metering jet 29, so that the fuel 32 is discharged at a rate which is metered in coordance with the above-stated flow rate of the intake air.

During the idling operation as illustrated in FIGS. 2 and 3, the head 35 of the suction piston 17 is positioned close to the bridge 16, because the flow rate of intake air is small, and the venturi section 42 is closed only by a small opening degree which has been set beforehand.

Therefore, the fuel which is sucked up through the suction pipe 33 and induced through the metering jet 29 is not mixed with air in the throttle valve 29, but flows in contact with and along the inner surface of the throttle bore, assuming a form of a liquid film A as illustrated.

However, since the throttle valve 38 is pivotally mounted at a level as high as possible, because it does not interfere with the suction piston as stated before, the upper edge of the throttle valve in the idling state is positioned just beneath the metering jet 29. In consequence, the liquid fuel in the form of the film A is allowed to contact the upper edge of the throttle valve and uniformly distributed over the entire part of that edge, before it is spread laterally on the barrel surface or divided into a plurality of fuel pools by the flowing intake air. The fuel distributed over the entire area of the edge of the throttle valve is then effectively atomized by the subsonic intake air flow to form a mixture D which is induced into the mixing chamber 41.

In consequence, no pool of fuel attaching to the inner surface of the throttle bore and hence no irregular or random dropping of the liquid fuel are observed in the carburetor of this embodiment.

Figure 4A:
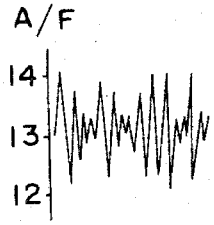
FIGS. 4*a* and 4*b* show changes of air-fuel ratios during idling in the conventional carburetor, and in the carburetor of the invention, respectively.
Figure 4B:
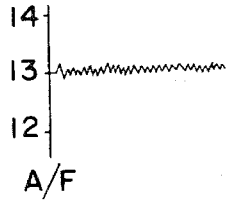

Since the oblique or tapered surface 36 of the suction piston 17 eliminates the edge of the suction piston, it conveniently performs a function to uniformly spread and guide the intake air flow so as to allow no liquid fuel attaching to and remaining on the oblique or tapered surface 36 and the other portions of the suction piston head 35 and, hence, no dripping of the liquid fuel drop onto the throttle valve 38. These functions in combination ensure an almost perfectly stabilized air-fuel ratio of the mixture, and the undesirable fluctuation of the air-fuel ratio is conveniently avoided as will be seen from FIG. 4*b*.

As the throttle valve 38 is quickly moved in the opening direction for a quick acceleration of the engine, the opener rod 25 is actuated by the cam 40 provided at the end of the throttle shaft 39 to abut and push mechanically the flange 18 which in turn forcibly move the suction piston 17 aback overcoming the force of the suction spring 19. Consequently, the throttle valve 38 is allowed to quickly and smoothly move into the full opening position, without interfering with the suction piston 17, particularly the head 35 including the oblique or tapered portion 36.

In the described embodiment, the throttle valve is pivotally mounted at a level which is as high as possible thanks to the provision of the oblique or tapered surface 36 of the suction piston 17. In this embodiment, therefore, the whole height of the carburetor is reduced by the height corresponding to the rise of the position of the pivotal mounting of the throttle valve. However, this arrangement is not exclusive. Namely, as an alternative embodiment, the throttle valve can be mounted at the same low level as in the conventional variable venturi type carburetor, or at a level intermediate between the level in the described embodiment and the level in the conventional carburetor.

In such alternative embodiment, there is a tendency, more or less, that the liquid fuel film A attaching to the inner surface of the throttle bore is spread laterally along that surface. However, also in this embodiment, the oblique or tapered surface 36 of the suction piston, which eliminates the edge of the latter, effectively prevents the attaching of liquid fuel to the suction piston 17, as in the case of the previously described embodiment, and the unstability or fluctuation of the air-fuel ratio during the idling is suppressed correspondingly. In addition, since the intake air is conveniently guided and spread as it flows along the oblique or tapered surface 36, the liquid film A of the fuel flowing laterally along the throttle bore wall, even when such a lateral flow is allowed, is not divided into plurality of the drops or pools but, rather, spread evenly to generate a uniform wet state on the wall of the throttle bore. Since the liquid fuel contacts the throttle valve 38 in thus uniformalized state, the air-fuel ratio of the mixture is stabilized during idling.

The above described embodiments are not exclusive and various changes and modifications may be imparted thereto.

For instance, it is possible to form a step in the oblique or tapered surface 36 is illustrated, so as to control the flow of the intake air, or to optimize the operational and positional relations between the throttle valve and the suction piston. It is also possible to employ an oil damper.

As has been described, according to the invention, there is provided a variable venturi type carburetor having a suction piston carrying at its end a metering needle for cooperation with a metering jet and adapted to move into and out of a suction chamber, wherein the head of the suction piston is cut obliquely at its side closer to the throttle valve. Therefore, as a basic advantage of the invention, the undesirable attaching of liquid fuel drop to the head edge of the suction piston and, hence, the dropping of the liquid fuel from the head edge, which has been inevitable in the conventional carburetor, is fairly avoided. Therefore, the irregular dropping of the fuel from the suction piston onto the throttle valve is prevented to stabilize the air-fuel ratio during the idling of the engine.

The oblique or tapered surface of the suction piston head on the other hand prevents the generation of eddy currents of the intake air flowing through the throttle bore. Therefore, the undesirable division or separation of the liquid fuel attaching to the upper wall of the throttle valve is fairly avoided to ensure a uniform distribution of the fuel over the entire peripheral edge of the throttle valve. The liquid thus uniformly distributed is effectively atomized by the intake vacuum established in the intake manifold, and the air fuel ratio during the idling operation is rendered stable also by this reason. This also offers an advantage to improve the transient characteristic of the variable venturi type carburetor having no slow system.

Further, since the head of the suction piston is cut obliquely to eliminate the edge, the unfavourable interference of the throttle valve in the fully-opening state or in the course of opening to the full-opening position with the suction piston is avoided solely by this reason.

For this reason, it is possible to mount the throttle valve at an elevated position in the throttle bore, so as to permit the upper end edge of the throttle valve to be located just beneath the metering jet. By so arranging, it becomes possible to make the injected liquid fuel film contact the throttle valve uniformly at the peripheral edge of the latter, before the liquid fuel is scattered or spread by the intake air flow, so that the atomization is promoted and rendered uniform to stabilize the air-fuel ratio of the mixture during the idling operation of the engine.

Particularly, in case of a multi-cylinder engine, the air-fuel mixture of less-fluctuating air-fuel ratio is evenly distributed to all cylinders to stabilize the engine operation.

Finally, the elevation of the mounting position of the throttle valve permits to reduce the barrel length correspondingly to advantageously afford a reduction of the whole height of the carburetor, as well as the weight of the same.

What is claimed is:

1. A variable venturi type carburetor having a suction chamber, a suction piston movable into and out of said suction chamber, a metering needle attached to the head portion of said suction piston, a metering jet faced by said metering needle and a throttle valve, said head portion of said suction piston confronting the venturi section defined at the upstream side of said throttle valve, characterized in that said head portion is obliquely cut or shaped at its one side opposing to said throttle valve to define an obliquely cut or shaped piston portion, and that said throttle valve is pivotally mounted at such a position relative to said piston that at least a portion of said throttle valve pivots during opening movement within space vacated by said obliquely cut or shaped piston portion as said piston moves in an opening direction.

2. An improved variable venturi carburetor in a accordance with claim 1, wherein the posture of said throttle valve in the fully-opened state effects a reduced height of a portion of it to said obliquely cut or shaped portion of the suction piston in idle state.

3. An improved variable venturi carburetor in a accordance with claim 1 or 2, including a throttle shaft, a cam connected to said throttle shaft and an opener rod between said suction piston and said cam connected to the throttle shaft.

4. An improved variable venturi carburetor in accordance with claim 3, wherein said obliquely cut or shaped piston portion defines an oblique surface which in substantially parallel to said throttle valve when it is in its substantially closed position.

5. An improved variable venturi carburetor in accordance with claim 1 or 2, wherein said obliquely cut or shaped piston portion defines an oblique surface which is substantially parallel to said throttle valve when it is in its substantially closed position.

* * * * *